United States Patent [19]

Botting et al.

[11] 4,042,659

[45] Aug. 16, 1977

[54] METHOD OF MOLDING MODULAR BUILDINGS

[76] Inventors: Alden Joseph Botting, 97 Westhumber Boulevard, Rexdale, Ontario; John Michael Mulcahy, 1500 Eglinton Avenue W., Apt. 409; William James Hannah, 376 O'Connor Drive, both of Toronto, Ontario, all of Canada

[21] Appl. No.: 467,365

[22] Filed: May 6, 1974

[51] Int. Cl.[2] ..... B28B 1/08; B28B 1/10

[52] U.S. Cl. ..... 264/71; 249/144; 264/333; 264/336; 425/253; 425/452

[58] Field of Search ..... 264/71, 333, 334, 336, 264/35; 249/26, 27, 63, 144; 425/468, 253, 255, 330, 452, 454, DIG. 117

[56] References Cited

U.S. PATENT DOCUMENTS

| | | | |
|---|---|---|---|
| 3,273,216 | 9/1966 | Gourlie | 425/253 |
| 3,609,830 | 10/1971 | Myklebost | 264/333 |
| 3,714,304 | 1/1973 | Carner | 264/333 X |
| 3,860,214 | 1/1975 | Schmidgall | 249/144 |

FOREIGN PATENT DOCUMENTS

| | | | |
|---|---|---|---|
| 149,051 | 1962 | U.S.S.R. | 249/26 |
| 127,170 | 1960 | U.S.S.R. | 425/468 |

*Primary Examiner*—Thomas P. Pavelko
*Attorney, Agent, or Firm*—Arne I. Fors

[57] ABSTRACT

A moulding method utilizing apparatus for forming a monolithic reinforced concrete modular building structure comprising walls and floor with apertures therein for doors, windows and the like. The apparatus comprises separable mould components in the form of a floor, end walls, side walls and a core moveable into cooperation with each other and a wheeled pallet to define a moulding cavity for forming the module, and out of cooperation to leave the formed module free for withdrawal on the pallet from the apparatus. The moulding apparatus is controllably connected to a source of pressurized wet concrete for filling the mould and is enclosed within an autoclave for accelerating the initial curing process of the concrete in the mould by heating.

5 Claims, 15 Drawing Figures

106
104
108
103
102
100
88
33
36
35
23
44
47

METHOD OF MOLDING MODULAR BUILDINGS

BACKGROUND OF THE INVENTION

This invention relates to a method and apparatus for the manufacture of reinforced concrete modular buildings.

Reinforced concrete walls and floors often are moulded in situ by the use of concrete forms made of wooden planks or of plywood or steel sheets. The forms often are not re-useable or have a short effective life only, requiring costly skilled or semi-skilled workmen to install and to dismantle them.

SUMMARY OF THE INVENTION

We have invented a method and apparatus for moulding a monolithic reinforced concrete modular building unit, suitable for transportation and assembly with other like units, if desired, to form an integrated building structure. The apparatus of the invention comprises a closed-bottom interior core and a pair of opposed exterior mould end-walls mounted for reciprocal vertical travel above a retractable exterior mould floor. A pallet-supporting trackway is disposed along each side of the retractable exterior mould floor and below the level of the interior core for introducing and supporting a steel reinforcing mesh assembly having door and window cut-outs and the like between the floor mould and core and for removing a finished product therefrom. Horizontally reciprocal exterior mould side walls are extensible into near abutment with the core mould and into tight-fitting abutment with the pallet and the end walls and the mould floor is elevatable into near abutment with the core and tight-fitting abutment with the pallet to define a moulding cavity containing the reinforcing mesh. Concrete is injected into the moulding cavity under pressure, vibrated to remove air occlusions and permitted to partially cure. Curing also may be accelerated by enclosing the mould apparatus in a large autoclave and applying heat. The exterior mould walls and interior core are removed by retraction from the partially-cured building unit and the building unit removed on the pallet for storage and completion of cure.

By the construction and arrangement of the apparatus of the present invention, a reinforcing mesh assembly may be readily positioned on a pallet to receive the mould components for injection of concrete and, upon partial curing of the structure, the mould components quickly retracted for removal of the resulting building unit and positioning of reinforcing for the next unit. The mould apparatus can be re-used an indefinite number of times with a minimum of skilled labour.

BRIEF DESCRIPTION OF THE DRAWINGS

The description will now proceed with reference to the accompanying drawings, in which.

DESCRIPTION OF THE PREFERRED EMBODIMENT

Figure 1:
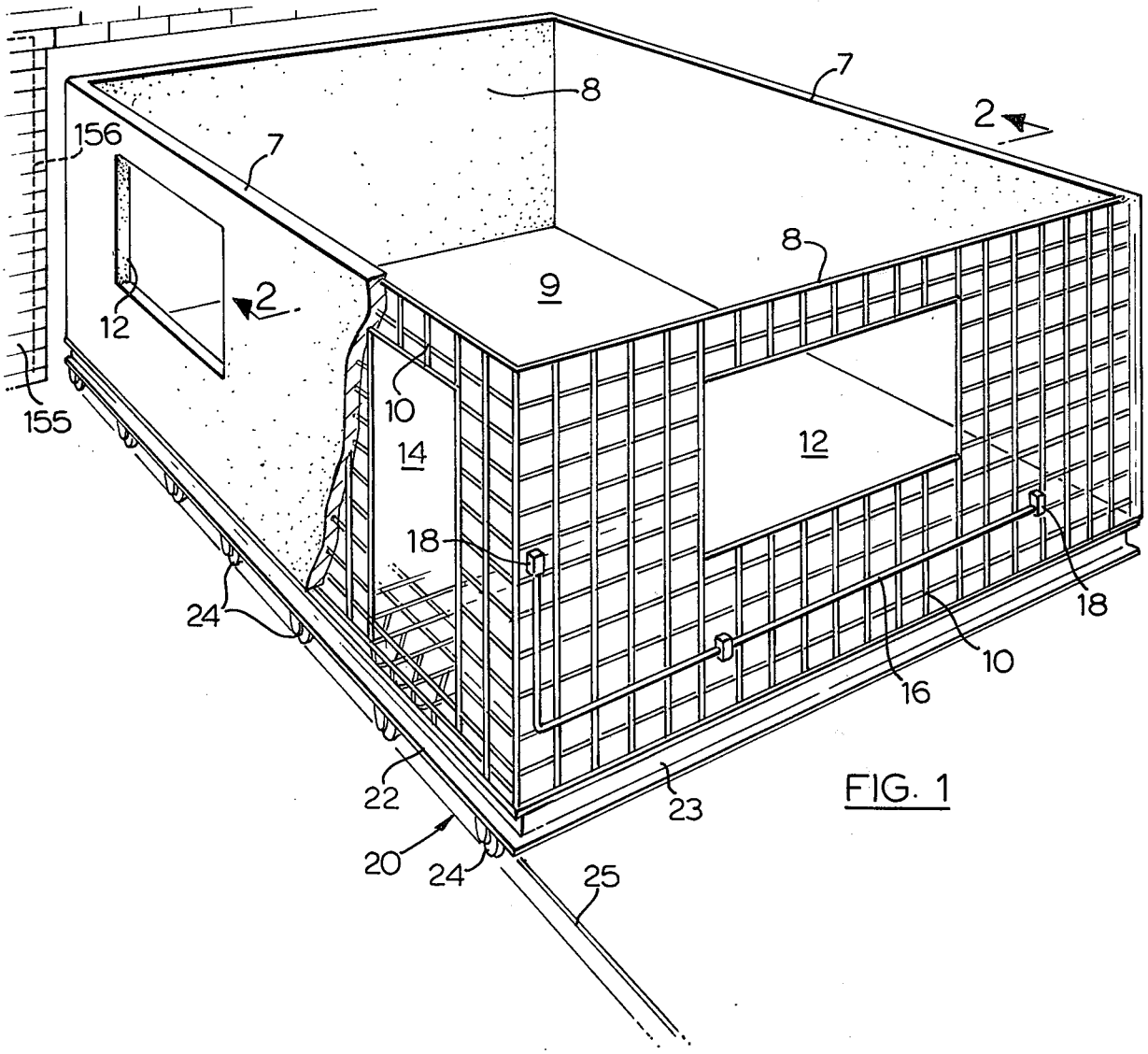
FIG. 1 is a perspective view of a modular building unit of the present invention showing a steel reinforcing mesh supported by a pallet and having door and window cut-outs and electrical conduits mounted therein.
Figure 2:
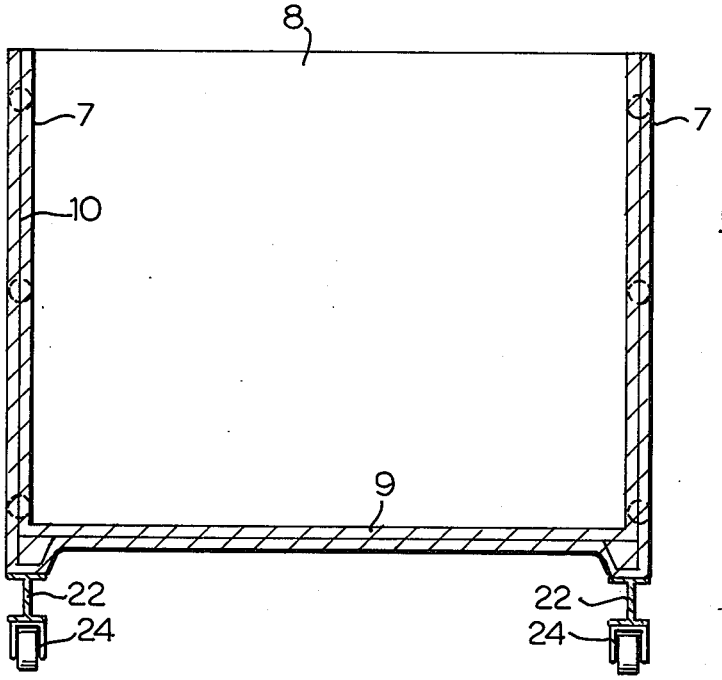
FIG. 2 is a transverse section taken along line 2 — 2 of FIG. 1.

The mould apparatus of the present invention produces a monolithic reinforced concrete modular building unit as shown in FIGS. 1 and 2 having side walls 7, end walls 8 and floor 9 with an internal reinforcing rod or wire mesh assembly 10 having window cut-outs 12 and a door cut-out 14 and carrying conduits such as 16 and receptacle boxes 18 for electrical wiring.

Mesh assembly 10 is supported on an open-frame pallet designated by numeral 20 comprising longitudinal and transverse I-beams 22, 23 having rollers 24 journalled thereunder for travel on tracks 25.

Figure 3:
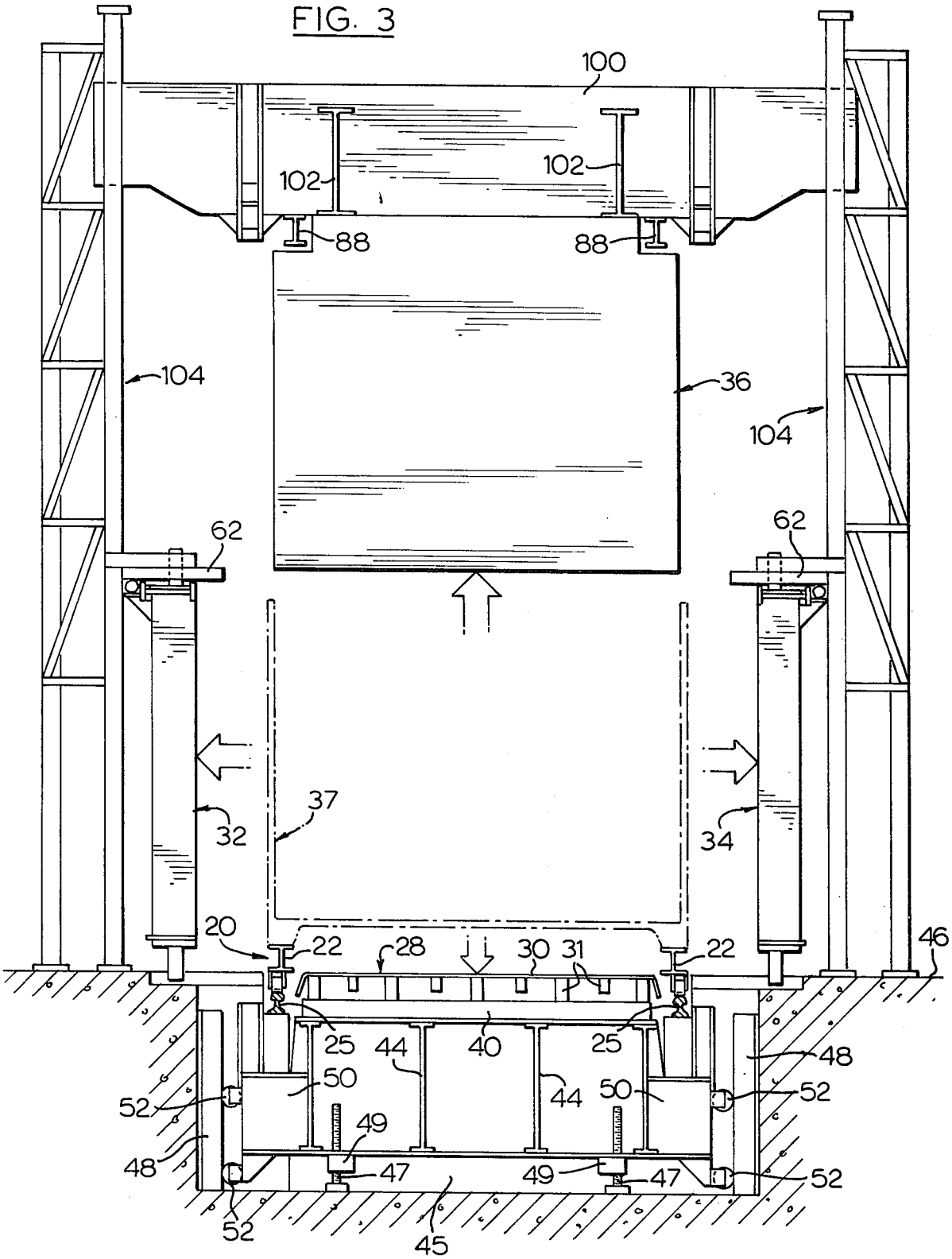
FIG. 3 is an end elevation of the mould apparatus of the present invention, with the mould components shown in an opened position and with an end wall removed for clarity.

With reference now to FIG. 3, there is shown the mould apparatus of the present invention in its opened position with a mould floor 28, mould side walls 32, 34, and mould core 36 in their respective retracted positions. Mould end walls 33, 35 are shown in FIG. 10 with details in FIGS. 8 and 9. A finished product designated by broken lines 37 (FIG. 3) is shown positioned on pallet 20 preparatory to its removal from the moulding station.

Figure 14:
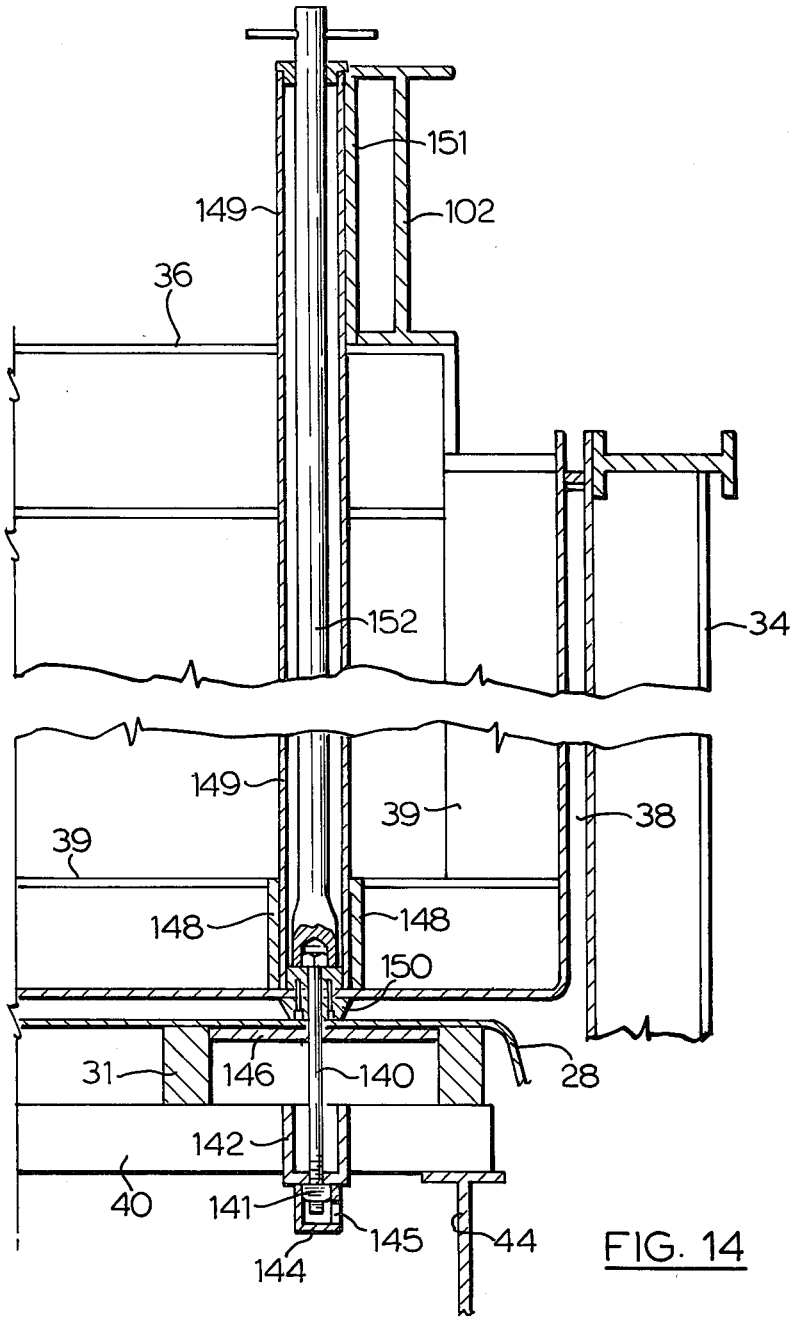
FIG. 14 is a similar view to FIG. 7 showing an alternative locking mechanism to that shown in FIGS. 11 and 12.

Core 36 is a generally rectangular box member heavily reinforced by an internal girder frame indicated by the numeral 39 (FIG. 14). The core is supported by structure adapted to raise and lower it as will be described later herein.

Mould floor 28 has a floor surface 30 backed by longitudinal tubular stringers 31 rigidly supported on transverse tubular beams 40 which in turn are carried by longitudinal I-beams 44. Mould floor 28 is mounted for vertical reciprocal travel within a well 45 in foundation floor 46 by screwjacks 47 each having a jack nut 49 actuated by a synchronized, motorized driving system (not shown) for raising and lowering mould floor 28 from a horizontal position shown in FIG. 3 to the horizontal position shown in FIG. 4. Mould floor 28 is guided for vertical travel by a pair of dollies 50 positioned at each end of the mould apparatus, each dolly having a pair of vertically spaced rollers 52 travelling on opposed vertical rails 48.

Figure 6:
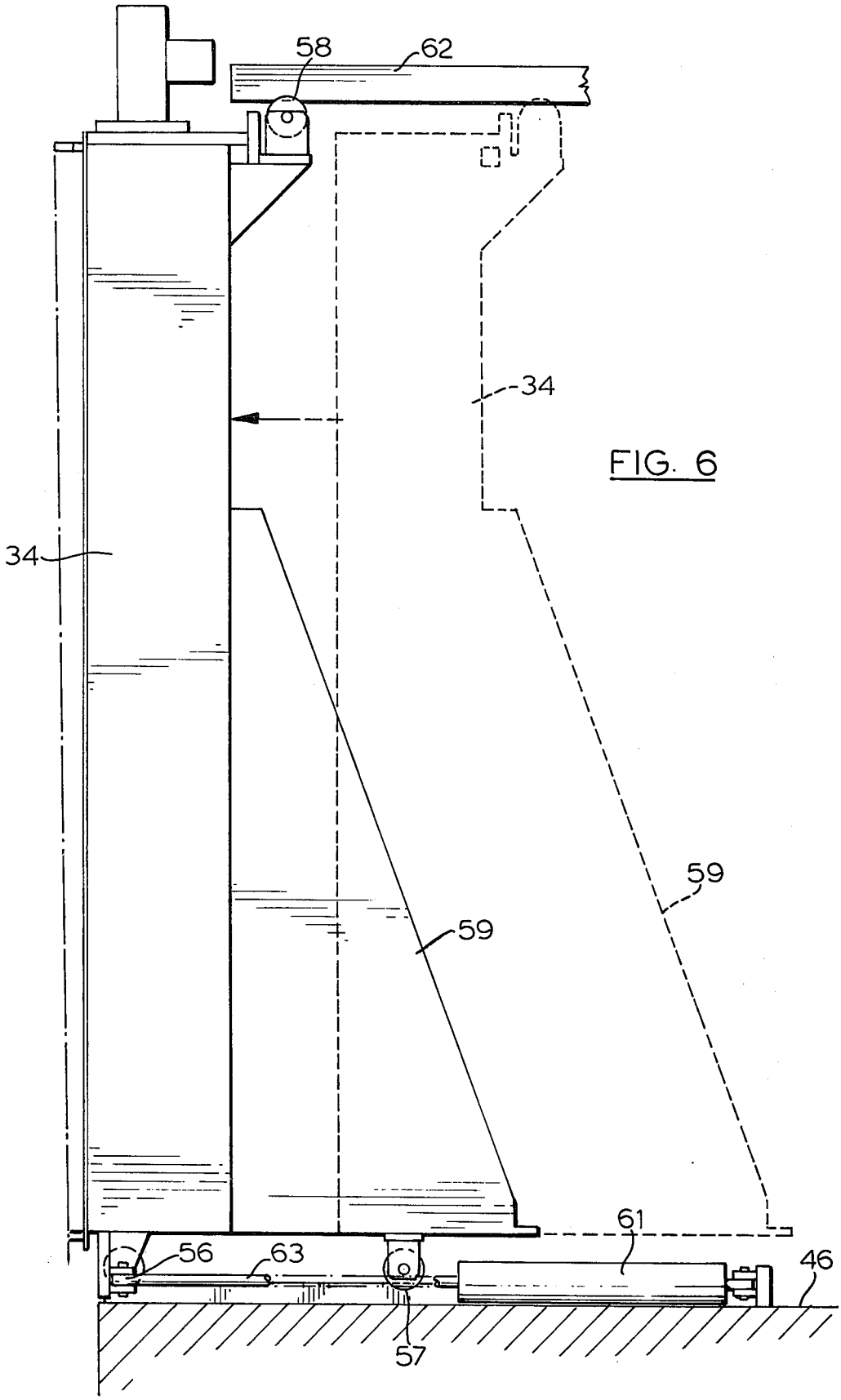
FIG. 6 is a side elevation of a mould side wall support assembly.

Mould side walls 32, 34 are adapted for horizontal lateral travel towards and away from core 36 by a support assembly shown most clearly in FIG. 6. Wall 34, shown for purposes of illustration, has a plurality of support rollers 56, 57 journalled as indicated to the underside of wall 34 and reinforcing gusset 59 at spaced intervals therealong whereby wall 34 can be moved from its closed position shown by the solid lines to its opened position indicated by the broken lines. A double-acting hydraulic ram 61 pivotally connected to foundation floor 46 extends and retracts wall 34 by means of ram rod 63 secured to wall 34. The upper extremity of wall 34 carries a roller 58 which abuts a rail 62. It will be evident that roller 58 is disposed in a vertical plane between rollers 56 and 57 such that wall 34 cannot pivot about the axes of either roller 56 or 57 without roller 58 abutting rail 62 to counter any pivotal action.

Figure 7:
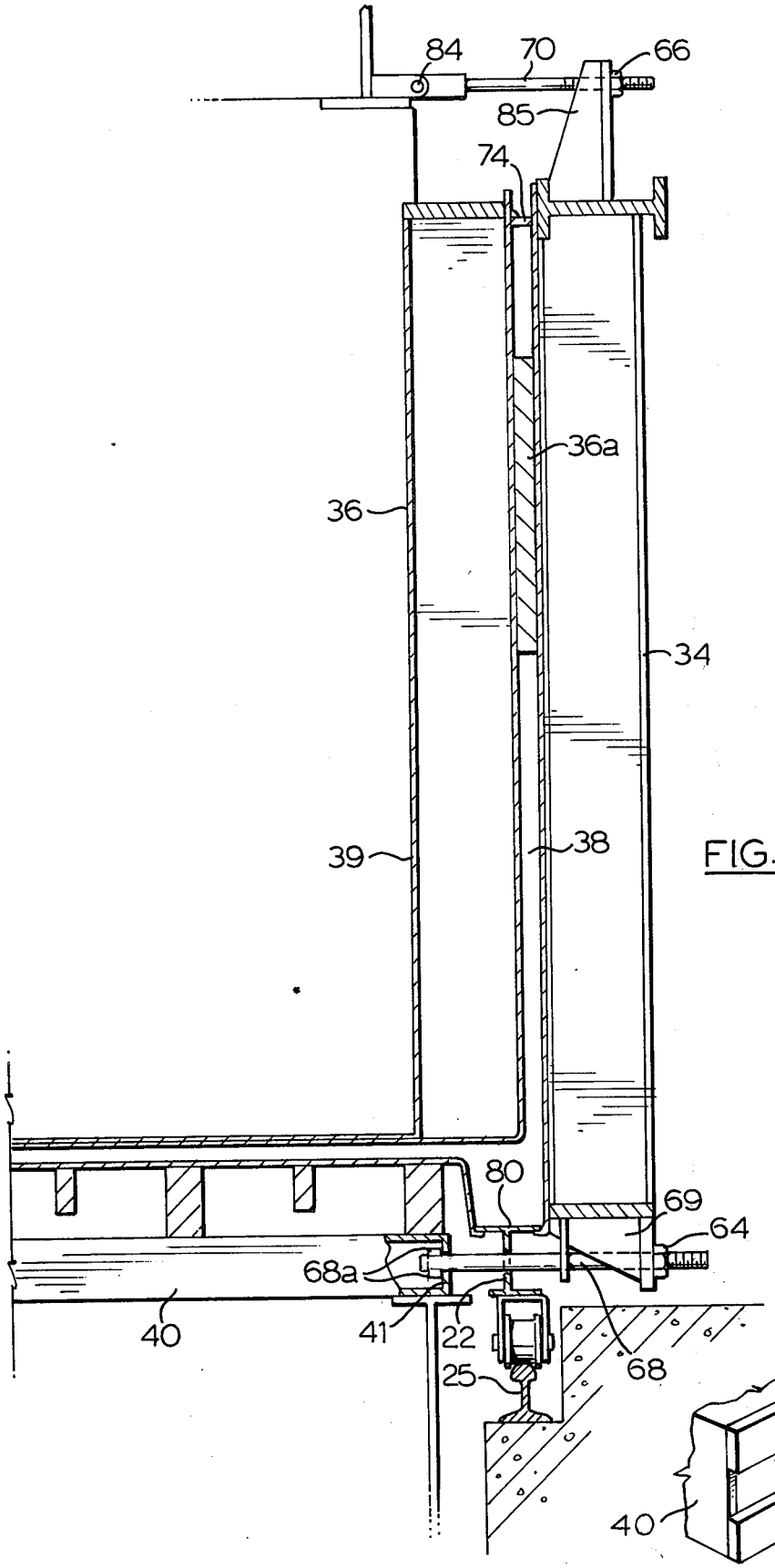
FIG. 7 is a section through a mould side wall showing the side wall locking mechanism.

With reference to FIG. 7, it may be seen and understood that mould wall 34 is locked to core structure at the top by a series of tie rods such as 70, pivotally mounted at 84 for lowering into slots (not shown) of lug fittings such as 85 along the top of wall 34. The wall is held in tight abutment against a longitudinal flange 74 on core 36 which is the upper closure of moulding cavity 38 formed by the mould apparatus main components.

Figures 4, 5:
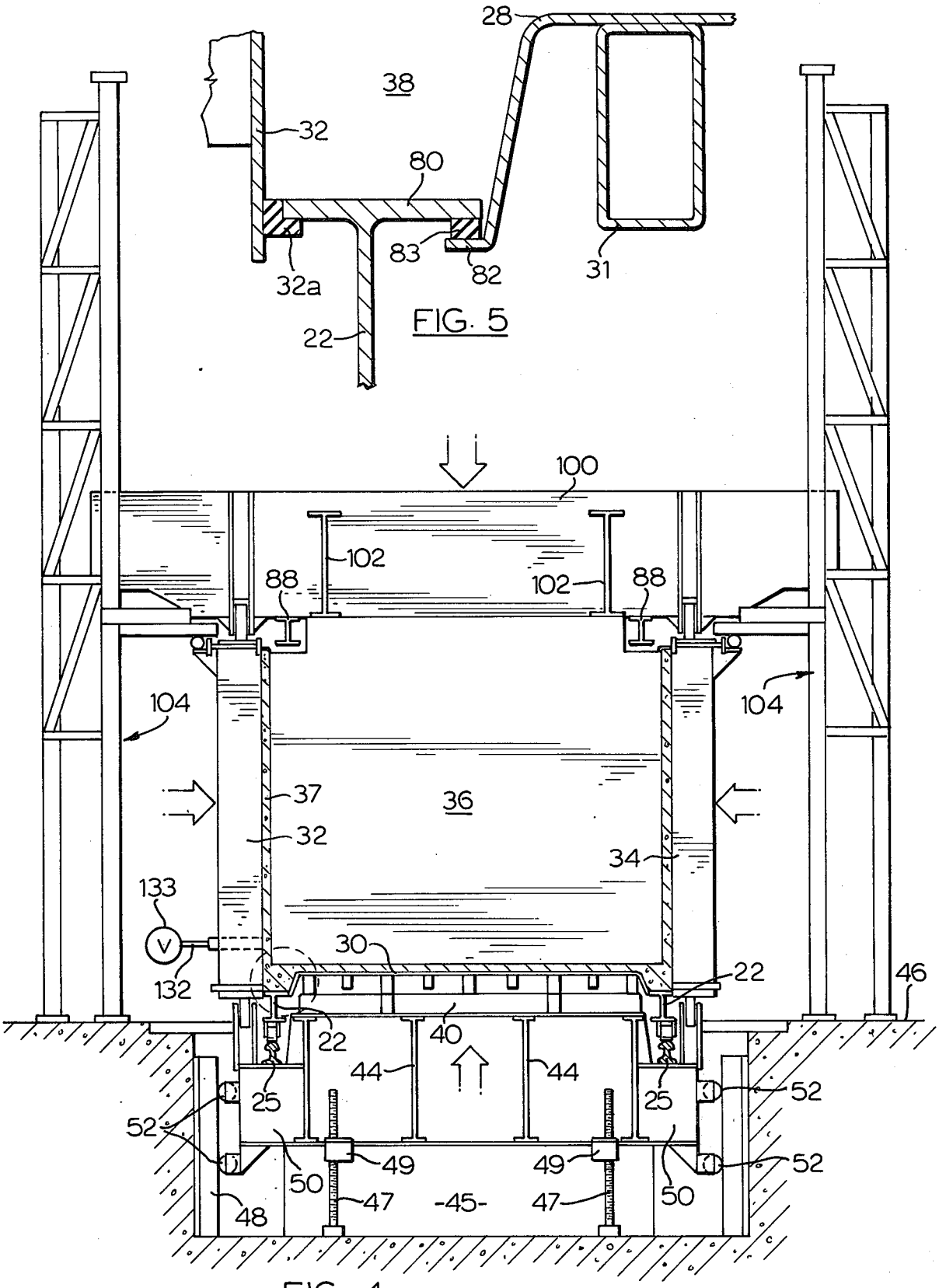
FIG. 4 is an end elevation similar to FIG. 3 with the mould components shown in a closed position and with an end wall removed for clarity.
FIG. 5 is an enlarged detail of the ringed portion shown in FIG. 4.

Referring now to FIG. 5, this detailed figure illustrates the interconnection of a lower sealing strip **32*a* on wall 32 and a sealing strip 83 on a flange 82 of mould floor 28, with an upper flange 80 of pallet I-beam 22, to form a lower closure of moulding cavity 38.**

Figure 7A:
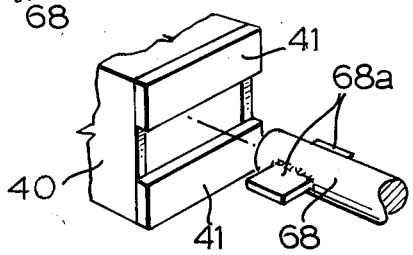
FIG. 7*a* is an enlarged detail, in perspective, of the locking bolts shown in FIG. 7.

Returning to FIG. 7, it will be seen that the components of the above interconnection are held in tight abutment by a series of tie rods such as 68 held in lug fittings such as 69 along the bottom of wall 34. Tie rods 68 have opposed lugs **68*a* which pass freely through holes in the web of pallet I-beam 22 and slotted end plates 41 on the ends of mould floor transverse tubular beams 40. As best seen in FIG. 7*a*, when tie rods 68 are turned 90° , the lugs 68*a* engage the end plates 41 and nuts 64** may be tightened to draw the mould components together. The tie rods also can be withdrawn completely clear from mould floor and pallet structure for lateral movement of the mould side walls.

Figure 8:
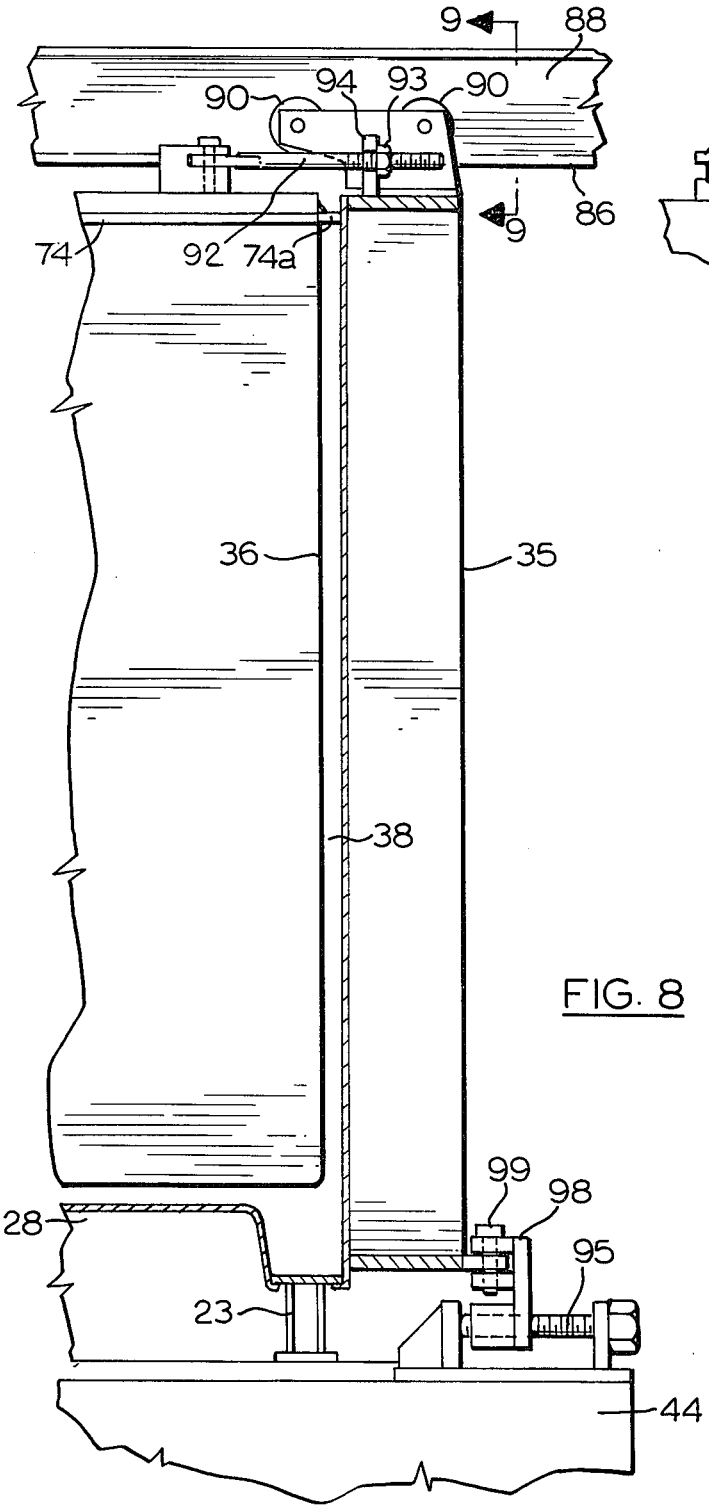
FIG. 8 is a section through a mould end wall showing the end wall locking mechanism.
Figure 9:
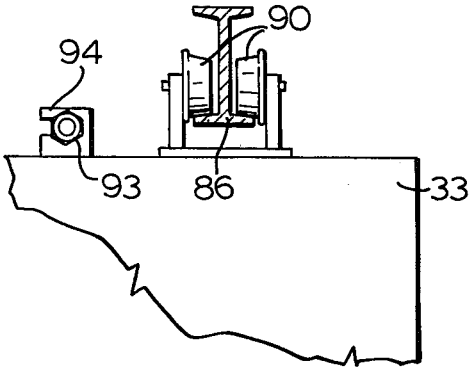
FIG. 9 is a section through line 9 — 9 of FIG. 8.
Figure 10:
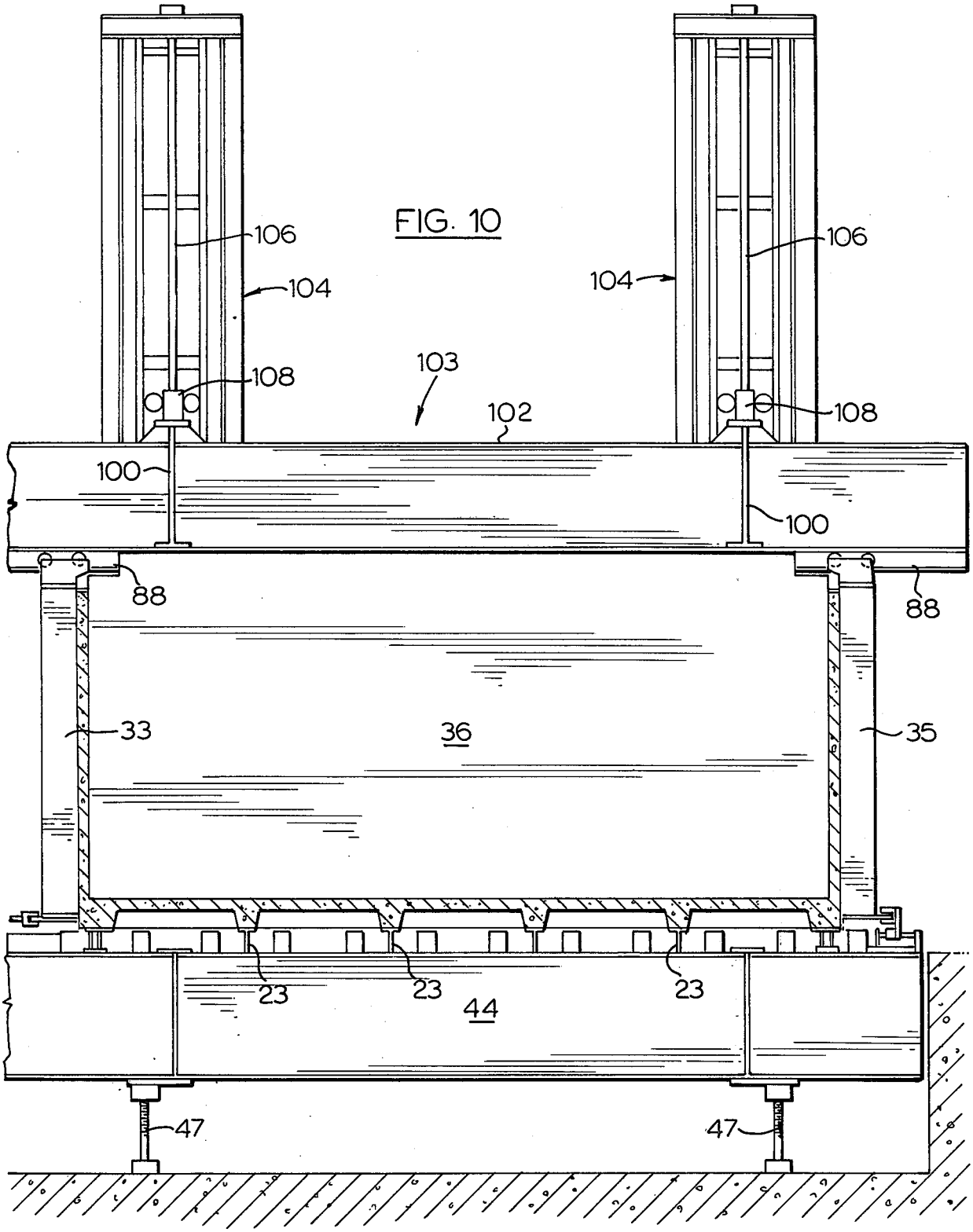
FIG. 10 is a side elevation partly in section, of the mould apparatus of the invention with the mould components shown in a closed position.

Mould end walls 33, 35 also are adapted for horizontal travel towards and away from core 36 as may be seen in FIGS. 8, 9 and 10. End wall 35 shown for purposes of illustration is mounted on flanges 86 of short longitudinal I-beams 88 by opposed rollers 90 journalled at each end of the wall.

With particular references to FIG. 8, the top of end wall 35 is locked to core structure by a series of swing-away threaded tie rods such as 92, having nuts 93 bearing against slotted lug fittings such as 94. The wall is held in tight abutment with a longitudinal flange **74*a* on core end which is a continuation of flange 74 on the core sides. Anchored on the end of each longitudinal I-beam 44 of the mould floor structure is a jack screw such as 95 carrying a travelling clevis 98 removably connected to a lug at the bottom of the end wall by a clevis pin such as 99.**

Figure 13:
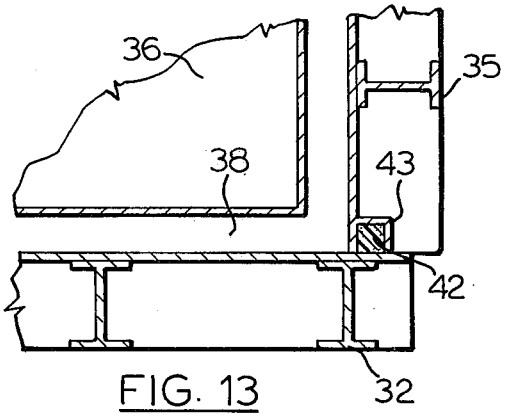
FIG. 13 is an enlarged section through line 13 — 13 of FIG. 12.

A seal between the bottom of wall 35 and pallet transverse I-beam 23 is similar to that of the side wall 34 with pallet longitudinal I-beam 22. Sealing of end walls 33, 35 to side walls 32, 34 is shown in detailed section in FIG. 13, and is by straight abutment of the inner surface at the ends of the side walls against a continuous sealing strip 42 held in a channel 43 along vertical edges of the end walls.

Cross beams 100, and longitudinal beams 102, together form a core and end wall supporting structure 103 mounted for reciprocal vertical travel on towers 104 as best shown in FIG. 10. Jack screws 106 depend from within the tops of the towers. Guided sleeves 108 containing rotatable jack nuts (not shown) are mounted on the extremities of cross beams 100 and supported by the jack screws. A synchronized drive system (not shown) actuates the jack nuts in sleeves 108 to raise and lower supporting structure 103.

Core 36 is attached to supporting structure 103 by any conventional means. Structure 103 also is adapted to carry I-beams 88 on which are removably supported end walls 33, 35.

FIG. 1 shows a building module having door and window cut-outs. These are produced by sub-cores such as **36*a* seen in FIG. 7. These sub-cores are positioned and fixedly secured to the inner surfaces of side and/or end walls to blank out the appropriate areas in the mould cavity 38 when the mould is closed. When the mould walls are withdrawn on opening the mould, these sub-cores are also drawn clear of the module to allow its removal from the mould. Any openings required in floors such as stair wells, for example, would be provided by suitable sub-cores attached to the bottom of the core 36.**

It will be seen that should it be required to cast window and door frames integrally with the module, these could be positioned and secured in the reinforcing mesh cut-outs. It would then be necessary to provide structure similar to sub-cores **36*a*** to support such frames against the pressure exerted by the concrete mix as it is pumped into the mould cavity.

Figure 11:
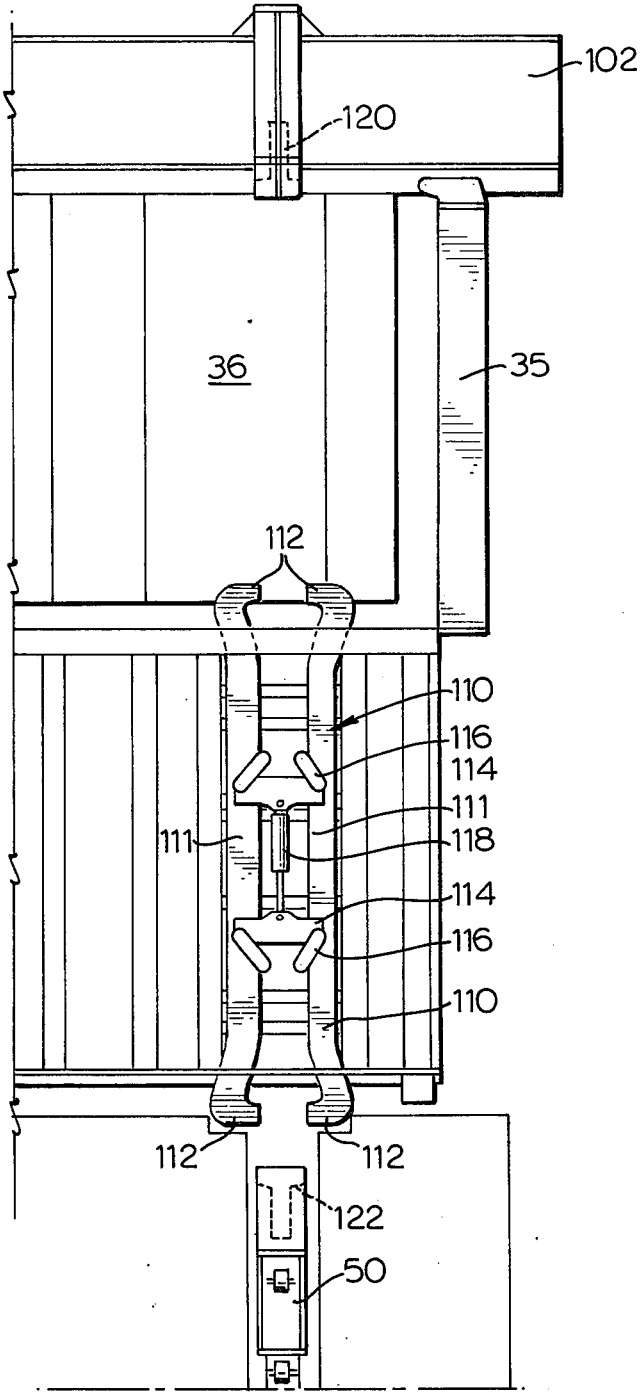
FIG. 11 is a side elevation of a portion of the mould apparatus showing a locking mechanism in its opened position.
Figure 12:
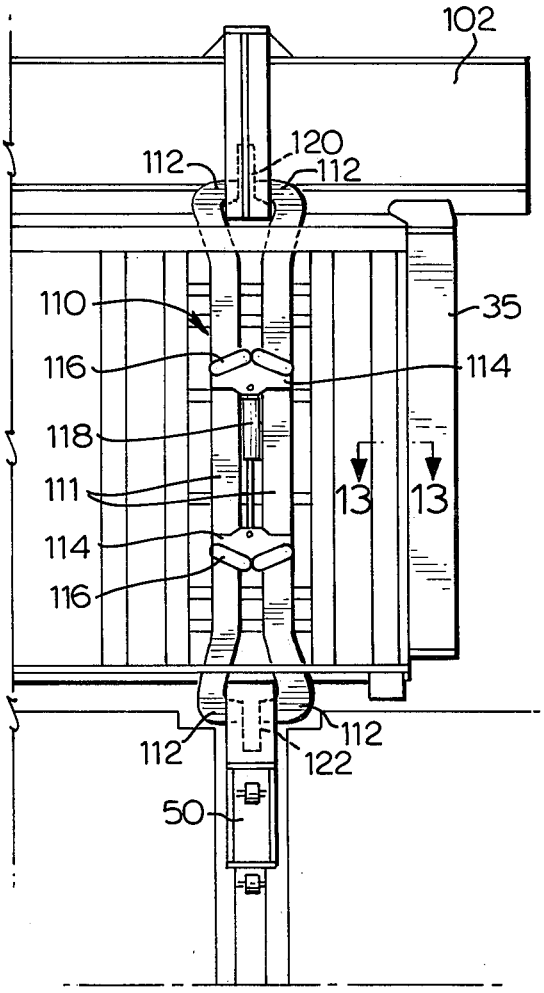
FIG. 12 is a side elevation of the apparatus as shown in FIG. 11 with the locking mechanism in a closed position.

FIGS. 11 and 12 show a toggle-operated clamp assembly 110 illustrative of four such clamps in the present embodiment, carried on the side walls 32, 34 and adapted to lock the core 36 to the mould floor 28 when the mould is in the closed position.

Toggle clamps 110 each comprise a pair of parallel arms 111 terminating in opposed jaws 112. The arms are slidably mounted on walls 32, 34 to move parallelly towards and away from each other to open and close jaws 112. The arms 111 are actuated by transverse members 114 pivotally connected at their terminal ends to the arms 111 by toggle links 116. The transverse members 114 have interposed between them a double acting hydraulic ram 118 whereby extension of the ram will cause arms 111 to move closer together under the urging of toggle links 116 thereby closing the jaws. Reversal of the ram 118 will of course have the opposite effect.

When the mould is in the closed position, the upper jaws 112 are arranged to engage structure 120 on cross beam 100 while the lower jaws 112 engage similar structure 122 on the dollies 50 attached to the mould floor supporting structure. The mould floor 28 is, therefore, releasably locked to the core 36 by massive structure which resists the tendency of the core to float up when wet concrete is pumped into the moulding cavity 38.

An alternative method of locking the core 36 to mould floor 28 is shown in FIG. 14. At several stations regularly disposed in the core and mould floor structures provision is made for hold-down bolts 140 and nuts 141 to releasably tie these components together.

Between adjacent cross beams 40 of the mould floor supporting structure straddling a bolt station a channel-section bridge 142 is provided bored to receive bolt 140. Below the bottom plate of the bridge 142 is welded a closed bottom nut box 144 adapted to receive square nut 141 through a side opening 145 in the box. Nut box 144 retains the nut 141 for pick up by the hold-down bolt 140 and prevents the nut from turning as the bolt is screwed home. Mould floor 28 is strengthened below its plating by a heavy member 146 welded between longitudinal hollow beams 31 at the bolt station. Member 146 is bored to receive bolt 140.

In the core 36, heavy bridge members 148 are welded to adjacent core reinforcing structure 39 at each bolt station and a large diameter vertical tube 149 plugged at the lower end is attached between members 148 as by welding. The plugged end of the tube is bored to receive hold-down bolt 140 and below the core plating a bored frusto conical member 150 is bolted through the plating to the plug end of tube 149. Tube 149 extends vertically up through the core structure to be attached by an upper end attachment plate 151 to longitudinal I-beam 102. Concentrically disposed within tube 149 is an elongated tube wrench 152 by which means the hold-down bolt 140 is turned from a remote position above the core structure. Semi-permanent attachment of the bolt to the tube wrench will allow withdrawal of stripped bolts and the insertion of new ones from the remote position.

An advantage of the alternative system is positive alignment of the core 36 with the mould floor 28. Another important advantage is that the core hold-down pressure is easily equalized at all stations by applying equal tightening torque to all the hold-down bolts.

It may be understood that the mould apparatus, large though it is, may be enclosed in a building, one wall of which is designated by numeral 155 (FIG. 1), having sealable door(s) 156, whereby mesh assemblies on pallets may be entered and completed modules withdrawn, which is in fact an autoclave. In the process of casting a concrete module, partial curing after initial set-up may be accelerated by heating the interior of the autoclave building by releasing live steam thereinto.

IN OPERATION

A module reinforcing mesh assembly 10 is prefabricated and loaded onto a pallet 20. With the autoclave building open, the moulding apparatus is opened up by raising the core 36 together with mould end walls 33, 35 which are moved away from the core. Mould side walls 32, 34 are moved laterally and the mould floor 28 is lowered. The mould and core surfaces are coated with a mineral oil release agent.

The pallet and mesh assembly 10 are wheeled along trackway 25 into position below the core 36 whereupon core 36 is lowered and floor 28 is raised to their respective positions as shown in FIG. 4. End walls 33, 35 are then moved up into place followed by side walls 32, 34 and are clamped up in tight abutment with the core, floor and pallet as already described. Core 36 and floor 28 are then clamped together by means of the clamp assemblies 110 or the alternative hold-down bolt system if fitted.

With the mould fully closed about the mesh assembly 10, wet concrete mix is pumped into the moulding cavity 38 through one or more inlets 132 having concrete shut-off valves indicated at 133 and which have been found to best be situated at a low level in one side wall. It has been found most convenient to introduce concrete in this manner to avoid entrapment of air as can occur if concrete is introduced into the top of the mould and/or from opposite sides simultaneously.

Occluded air as opposed to entrapped air is removed from the wet concrete as it is pumped by vibrators of known type which may be attached to various parts of the mould structure. Positions for attachment of vibrators are best found by experimentation. Filling of the mould cavity is indicated by uniform seepage around the upper sealing strips **74, 74*a* or bleed holes which may be provided in the strips. A further indication, of course, will be a back pressure on the concrete pump at which point the concrete valves 133** are shut off and the pump line backwashed.

With the autoclave building open to atmosphere, the concrete is allowed up to one hour to set up. The autoclave doors are then closed and steam is released into the interior of the autoclave and the temperature is raised at a rate of up to 40° F per hour to a temperature of 160° F. During this period, the concrete partially cures to a level at which the mould may be opened up — a reverse of the closing procedure — and the finished module withdrawn on its pallet for further curing.

It will be understood that although the foregoing description of the method and apparatus of the invention has proceeded with reference to the production of a monolithic building structure having a floor, opposed side walls and opposed end walls, it is contemplated the method and apparatus of the invention can produce building structures having a floor and one end or side wall, a floor and a pair only of adjacent walls or opposed walls, or a floor and three walls.

We claim:

1. A method of manufacturing a monolithic reinforced concrete modular building unit comprising the steps: horizontally moving and introducing a steel reinforcing mesh assembly supported on a pallet to a moulding position between an upwardly retracted closed-bottom interior core, adapted to be vertically reciprocal with a pair of opposed exterior end walls, and a downwardly retracted exterior mould floor; elevating said mould floor vertically upwardly into tight abutment with the pallet and extending said interior core vertically downwardly towards said floor mould into rigid alignment and near abutment therewith for defining a floor space therebetween, said end walls moving vertically downwardly with said core; extending said pair of opposed exterior end walls horizontally inwardly towards each other into tight abutment with the pallet and into near abutment with the core for defining end wall spaced therebetween; extending a pair of opposed exterior side walls horizontally towards each other into tight abutment with the pallet and into near abutment with the core for defining side wall spaces therebetween, said floor space and said end and side wall spaces forming a continuous moulding cavity; introducing concrete into the moulding cavity; permitting said concrete to partially cure; retracting the opposed mould end and side walls outwardly from each other, retracting the interior core vertically upwardly with the said retracted end walls, and retracting the mould floor downwardly from the partially cured concrete; and removing the resulting building unit on the pallet from the moulding position.

2. A method as claimed in claim 1, partially curing the concrete in an autoclave by heating said concrete at the rate of 40° F per hour to a temperature of 160° F before removal from the moulding cavity.

3. A method as claimed in claim 1, closing the moulding cavity at the top of the side and end wall spaces.

4. A method as claimed in claim 3, introducing concrete into the moulding cavity at a low level therein by injection under pressure and vibrating said concrete to remove air occlusions.

5. A method as claimed in claim 4, clamping the interior core to the mould floor and to the upper edges of the mould walls and clamping the lower edges of the mould walls to the mould floor and the side walls to the end walls in tight abutment to form a closed continuous mould cavity.

* * * * *